United States Patent [19]

Yoshiwara et al.

[11] 4,289,011

[45] Sep. 15, 1981

[54] CONTINUOUS PIPE ROLLING PROCESS

[75] Inventors: Seishiro Yoshiwara; Hirokichi Higashiyama, both of Kitakyushu, Japan

[73] Assignee: Nippon Steel Corporation, Tokyo, Japan

[21] Appl. No.: 94,316

[22] Filed: Nov. 14, 1979

[30] Foreign Application Priority Data

Nov. 17, 1978 [JP] Japan ..... 53-141073
Dec. 19, 1978 [JP] Japan ..... 53-156666

[51] Int. Cl.[3] ..... B21B 17/04
[52] U.S. Cl. ..... 72/208; 72/234
[58] Field of Search ..... 72/208, 209, 234, 235

[56] References Cited

U.S. PATENT DOCUMENTS 3,722,246 3/1973 Passous ..... 72/209
3,857,267 12/1974 Lemaire et al. ..... 72/209

*Primary Examiner*—Milton S. Mehr
*Attorney, Agent, or Firm*—Wenderoth, Lind & Ponack

[57] ABSTRACT

A tubular blank is continuously rolled into a pipe through a mill which has a plurality of roll sets each comprising grooved driven rolls providing substantially circular passes of progressively reduced diameters. While the blank is passing through the roll sets, its interior is supported by a mandrel. The tail end of the mandrel is held by a pushing device when rolling is started. Namely, rolling is started by pushing the mandrel into the blank. The pushing of the mandrel is stopped between the time when the front end of the blank has passed the last roll center line in the first half roll set group and the time when it has reached before the roll center line of the last roll set. The tail end of the mandrel remains unreleased while rolling is continued. Then, the mandrel is released between the time when the tail end of the workpiece has passed the roll center line of the second last roll stand in the first half roll stand group and the time when it has reached before the roll center line of the last roll stand. After the mandrel has been released, too, the workpiece is continuously rolled through at least one stand. When the mandrel and workpiece have cleared the rolling mill, the mandrel is withdrawn from the workpiece.

7 Claims, 14 Drawing Figures

CONTINUOUS PIPE ROLLING PROCESS

BACKGROUND OF THE INVENTION

This invention relates to a process for continuously rolling seamless metal pipes.

There are two types of continuous seamless metal (such as steel) pipe rolling mills; the full-floating mandrel mill and the semi-floating mandrel mill. These continuous rolling mills change the outside diameter and wall thickness of a tubular blank, using a series of substantially circular passes formed by driven paired rolls and a mandrel, having a length that is greater than the distance between the first and last roll stands and the length of the tubular blank, adapted to be passed through the workpiece. The difference betwen the two types lies in how the mandrel is restrained during rolling. On the full-floating mill, no other force than the rolling force acts on the mandrel during rolling. With the semi-floating mill, the mandrel moves forward at a constant speed, restrained by a thrust block. As a consequence, the mandrel of the full-floating mill leaves the rolling mill with the rolled pipe to a stripper on the exit side thereof, where they are separated. By contrast, the semi-floating mill has an extractor, comprising three to four pairs of rolls, on its exit side to take the pipe off the mandrel. On completion of rolling, therefore, the mandrel remains inside the continuous rolling mill, with the rear end thereof held by the thrust block. As soon as the pipe and mandrel clear, the full-floating mill can start the next rolling, allowing a very high production rate per unit time. On completion of rolling, the semi-floating mill must retract the thrust block to return the mandrel onto an entry table. The next rolling cannot be started until the mandrel has been inserted in the next tubular blanks and moved forward to the starting position and the blank sent into the rolling mill by feed rolls. The result is a much lower production rate per unit time.

On the full-floating mill, just the same, the mandrel speed increases sharply every time the front or tail end of the workpiece passes between the adjacent rolls. This breaks the balance of volume velocity at each roll, causing a sharp change in the deformation process of the workpiece. This change results in localized extraordinary deformation, entailing dimensional variations, both longitudinally and circumferentially. To prevent overfills that might result from such sharp dimensional variations, the conventional full-floating mill has had to provide a large recess at the edges of the roll groove. To facilitate the withdrawing of the mandrel from the rolled pipe, in addition, their diameters must be differentiated by several millimeters to provide adequate clearance therebetween. As a consequence, four longitudinal projections, known as ridges, form on the internal surface of the pipe, damaging its dimensional accuracy. The amount of reduction per pass has been limited too, calling for extra pipe deforming steps and extra energy consumption. Common practice is to drive each roll set with an independent DC motor. Because of a large torque needed for biting the workpiece, motors, with very large capacities, which are needed only temporarily, are used. For steady rolling, especially the motors for the first and second roll stands require only one-third or less of the torque needed for biting. Evidently, costly high-capacity motors are not in full-time service.

For increasing the dimensional accuracy of the rolled pipe, proposal has been made to control the peripheral speed of the rolls with the progress of the workpiece. But a capacity increase in the roll drive system, comprising a motor, reduction gear and spindle, increases moment of inertia, weakening the response to the control.

On the semi-floating mill, the movement of the mandrel is kept at a constant speed that is lower than the travel speed of the workpiece at any part of the mill. By this means, friction between the mandrel and the internal surface of the workpiece is oriented in the same direction at all roll stands, so that a constant volume velocity can be maintained during rolling. This permits roll passes to be designed closer to true circle, which is conductive to the improvement of the dimensional accuracy of the rolled pipe. To produce this condition, the speed of the mandrel must be kept at a rate lower than the peripheral speed at the bottom of the first roll set throughout the entire rolling process. This, however, calls for still greater biting torques, and still greater motor powers, than on the full-floating mill. Besides, irregular biting is likely to occur. This sets limits on the reduction of the diameter, and the arc of contact of rolls. Consequently, the time during which each unit length of the mandrel is in contact with the workpiece increases to shorten its service life.

Continuously pulled by the thrust block during rolling, the mandrel of the semi-floating mill is subjected to a large axial tensile stress, which accelerates the development of cracks on the mandrel surface and shortens the mandrel life. The mandrel may sometimes break during rolling to cause a serious trouble.

SUMMARY OF THE INVENTION

This invention is intended for solveing the aforementioned problems with the conventional continuous pipe rolling processes.

An object of this invention is to provide a continuous pipe rolling process with high rolling efficiency and good product dimensional accuracy.

Another object of this invention is to provide a continuous pipe rolling process that permits the roll sets to bite the workpiece with small torque, and without failure or irregularity.

Yet another object of this invention is to provide a continuous pipe rolling process that holds back the development of cracks on the mandrel surface and prevents its breaking.

In order to achieve the above objects, the continuous pipe rolling process according to this invention comprises continuously rolling a tubular blank, with a mandrel passed therethrough, on a rolling mill comprising a plurality of tandem rolling stands, each stand comprising paired driven rolls which are grooved to form, in combination, a substantially circular pass, disposed one after another along the pass line. Rolling is started as the mandrel is pushed at a speed that is faster than the peripheral speed at the bottom of the first roll set and slower than that of the last roll set. The pushing of the mandrel is stopped between the time when the front end of the blank has passed the last roll center line in the first half roll set group and the time when it has reached before the roll center line of the last roll set. The tail end of the mandrel remains unreleased while rolling is continued. Then, the mandrel is released between the time when the tail end of the workpiece has passed the roll center line of the second last roll stand in the first half roll stand group and the time when it has reached before the roll center line of the last roll stand. After the mandrel has been released, too, the workpiece is continuously rolled through at least one stand. When the mandrel and workpiece have cleared the rolling mill, the mandrel, is withdrawn from the workpiece.

The process of this invention does not call for the withdrawing of the mandrel in the continuous rolling mill. The thrust block holding the mandrel can be retracted while the tail end of the workpiece is being rolled in the stands on the far side or the next tubular blank is approaching the rolling mill. This permits proceeding to the next rolling without interruption, shortening rolling cycle time and increasing operation efficiency.

The mandrel speed is kept at the desired rate while the front end of the workpiece is passing through the roll center lines of the first half group of roll stands. Therefore, variation of workpiece deformation in the passes can be held within the desired limits. The permits shaping each pass closer to a true circle. When the workpiece has run into the passes on the far side, the mandrel is released from the thrust block, then withdrawn from the tail end of the workpiece on completion of rolling. The length of the mandrel remaining inside the rolled pipe is shorter than on the conventional full-floating mill. The facilitates the mandrel removal from the rolled pipe, which in turn permits reducing the clearance therebetween and prevents the formation of ridges. All this results in pipes with higher dimensional accuracy and better-shaped contour.

In the near-side roll sets, thrust force of the mandrel working on the blank interior assists the front end of the workpiece in entering the roll pass. Therefore, biting torques for these rolls can be reduced. At least while the front end of the workpiece is passing through the first half group of roll center lines, the thrust block applies thrust force on the mandrel. The mandrel kept under compressive stress is less likely to develop cracks. This compressive stress results from pushing the mandrel at a speed greater than the pass-bottom peripheral speed at the first roll set. The mandrel comes under the influence of tensile stress when it has been released from the thrust block or in the exit-end stands where it travels slower than the workpiece. Advantageous for crack prevention, however, the tensile stress is smaller and works for a shorter time than on the conventional semi-floating mill.

DETAILED DESCRIPTION OF THE PREFERRED EMBODIMENTS

The continuous pipe rolling process of this invention can be effected by adding on the entry side of a full-floating mandrel mill a mandrel thrust block, a mandrel support for preventing mandrel buckling, and a tubular blank feeder.

Figure 1:
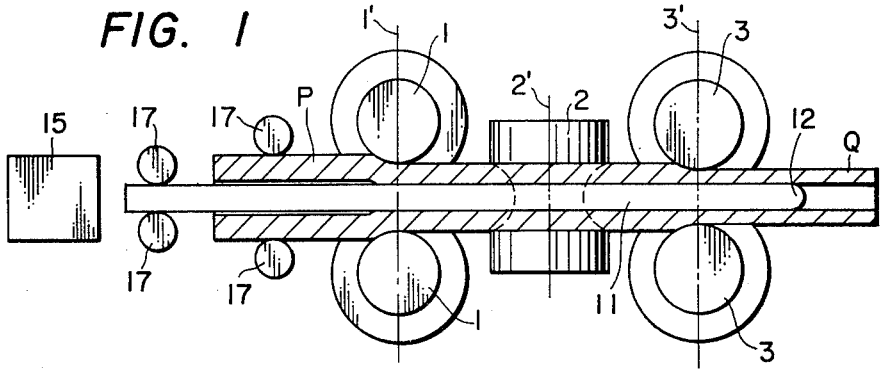
FIG. 1 is a schematic illustration exemplifying a rolling mill on which the process of this invention is implemented.
Figure 3A:
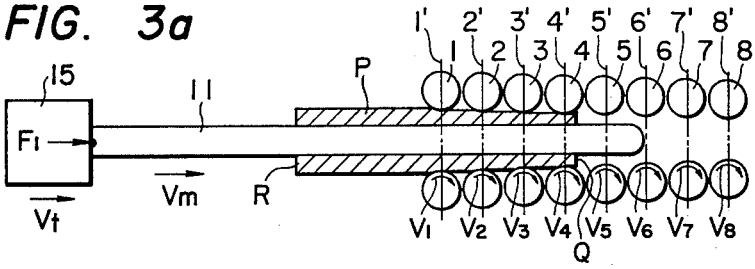
FIG. 3 shows how (with the direction of force applied) and when the thrust block restrains the mandrel: Sketch (a) shows the front end of the workpiece passing the fourth roll set, or the roll center lines of the first half group of whole roll stands; Sketch (b) shows the front end of the workpiece reaching before the last roll center line; Sketch (c) shows the tail end of the workpiece passing the third roll center line from the entry end; and Sketch (d) shows the tail end of the workpiece reaching before the last roll center line.
Figure 3B:
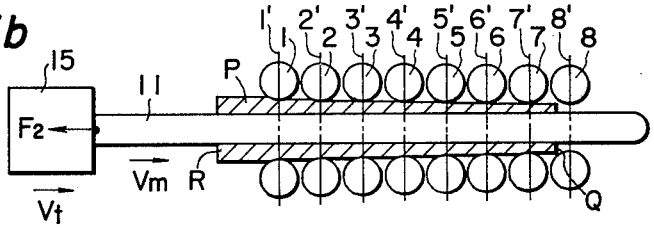
Figure 3C:
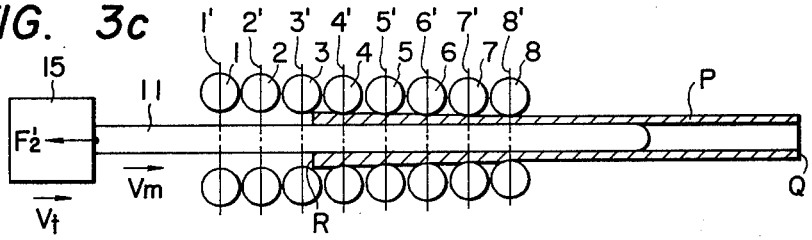
Figure 3D:
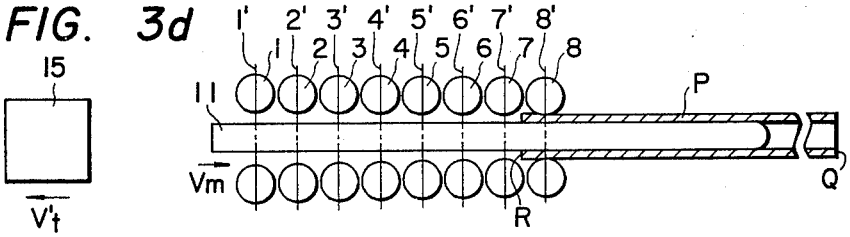
Figure 2A:
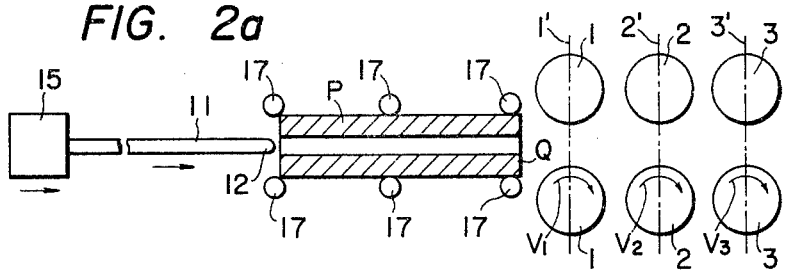
FIG. 2 schematically illustrates how the mandrel is pushed forward according to this invention; Sketch (a) shows the mandrel that is about to be inserted in a tubular blank; Sketch (b) shows the tubular blank being rolled, with the mandrel pushed therethrough; Sketch (c) shows the mandrel released from the thrust block before completion of rolling; Sketch (d) shows the tubular blank being continuously rolled, with the freed mandrel hald therein; and Sketch (e) shows the completion of rolling.
Figure 2B:
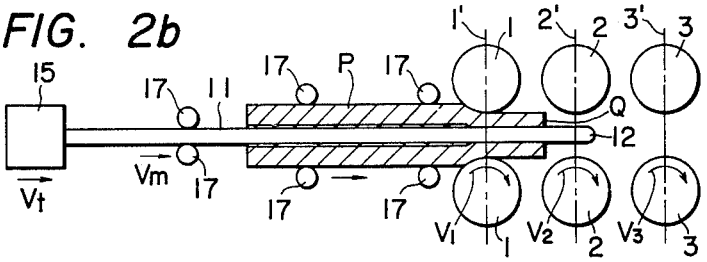
Figure 2C:
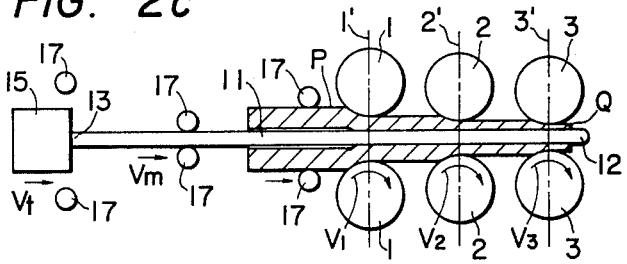
Figure 2D:
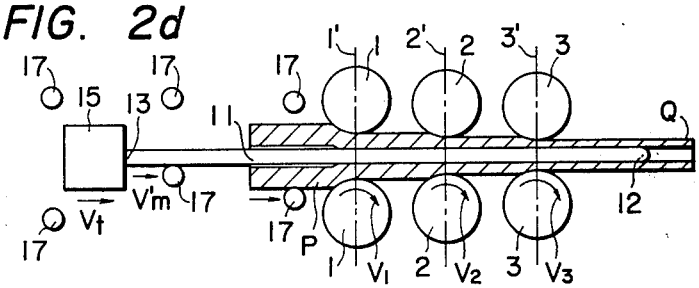
Figure 2E:
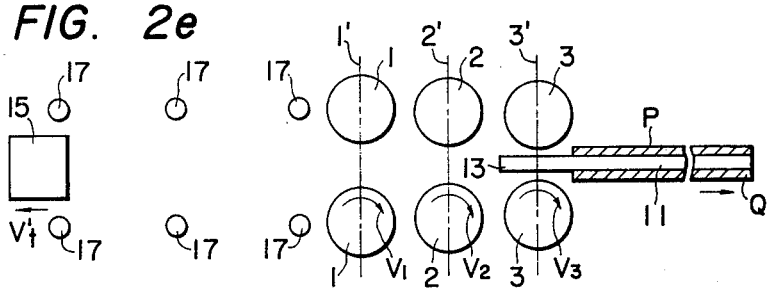

FIG. 1 schematically exemplifies a rolling mill on which the process of this invention is operated. Reference numerals 1 and 2 designate the first and second roll sets, with their grooved passes oriented at 90 degrees to each other. Reference numeral 3 denotes the third roll set which has its pass at 90 degrees to that of the second roll set, or identical with the first roll set. The same alternative arrangement is applied to the following roll sets. This process can be carried out on two or more roll sets, depending on the relationship between the sizes of the tubular blank and the finished pipe. Item 11 is a mandrel having a portion that performs pipe rolling in conjunction with the roll sets 1, 2 and 3. This portion is cylindrically shaped. The roll sets 1, 2 and 3 are grooved with substantially oval passes, with their ellipticity, preferably, approaching 1.0 toward the delivery end. The following describes the rolling process of this invention that is carried out on the above-described rolling mill.

To begin with, the mandrel is inserted in a tubular blank that is to be continuously rolled through a series of substantially circular passes formed by the driven roll sets. Rolling is started as the mandrel is pushed forward at a speed higher than the pass-bottom peripheral speed of the first roll set and lower than that of the last roll set. The mandrel is continuously pushed forward at least until the front end of the workpiece has passed the roll center lines of half of the whole roll sets. A first feature of this invention lies in that the thrust on the mandrel is released, either by extinguishing or converting into tensile force, before the front end of the workpiece has reached the roll center line of the last roll set.

In this invention, "pushing forward the mandrel" means to push forward the mandrel by applying a thrust to its tail end from the thurs block. When the front end of the workpiece has been bitten in the first roll set, compressive stress develops on the mandrel that then extends between said roll set and the thrust block. This condition results from sending forth the mandrel at a speed greater than the pass-bottom peripheral speed at the first roll set. When the workpiece front end has entered the second roll set, the rolling force thereof accelerates the mandrel speed within the limit of the peripheral speed at the bottom of its pass. The mandrel can be continuously pushed forward if the speed $V_t$ of the thrust block is made greater than the pass-bottom peripheral speed $V_2$ at the second roll set. This effect can be achieved even if $V_t$ is as low as approximately $(V_1+V_2)/2$. In the case of the i-th roll set from the entry end, $V_t$ may be as low as approximately $(V_1+V_2+\ldots+V_i)/i$. When the mandrel is pushed forward to the i-th roll set at a constant speed, $V_t>(V_1+V_2+\ldots+V_i)/i$.

Thrust on the mandrel is released either by keeping the speed of the thrust block, with the mandrel held thereby, below the afore-mentioned limit or disengaging the mandrel from the thrust block. In the former case, tensile stress works on the mandrel between the first roll set and the thrust block. In the latter case, this tensile stress becomes zero.

When employing the same rolling schedule as on the full-floating or semi-floating mill, the process of this invention calls for pushing forward the mandrel until the front end of the workpiece reaches the position where not less than 60 percent of the rolling work is completed. This reduces the change ratio of the mandrel speed. Beyond this point, the mandrel travels to the exit end, remaining inside the workpiece.

FIG. 2 exemplifies how the mandrel is pushed forward according to this invention. For simplicity, all rolls are shown as if they were oriented in the same direction, although they are, in reality, differently disposed as shown in FIG. 1. As shown in FIG. 2 (*a*), the thrust block 15 is moved forward in the rolling direction, as indicated by the arrow, to insert the mandrel 11 into a tubular blank p placed ready for rolling at the entrance of the rolling mill. Then, the mandrel alone is pushed forward until the front end 12 thereof emerges from the front end of the tubular blank. Pinch rolls 17 send the tubular blank into the first roll set 1. The thrust block, moving at a speed $V_t$, pushes the mandrel at a speed $V_m$ $(=V_t)$, which is greater than the pass-bottom peripheral speed $V_1$, to bring the front end of the workpiece into the bite of the first roll set 1. Then, as shown in FIG. 2 (*b*), the thrust on the mandrel is continuously applied to bring the front end Q of the workpiece and the mandrel front 12 past the roll center line 1' of the first roll set to the roll center line 2' of the second roll set 2.

Rolling is continued past the third roll set 3. In FIGS. 2 (*c*) and (*d*), the workpiece front Q and the mandrel front 12 are passing, and have passed, the third roll set 3, respectively. As seen, the thrust block 15 is pulled by the mandrel. FIG. 2 (*e*) shows the completion of rolling, with the rolled pipe P and mandrel 11 clearing the last roll set and the thrust block 15 withdrawing at a speed $V_t'$.

FIG. 3 illustrates the mandrel pushing and releasing timing on a mill with either sets of rolls. FIG. 3 (*a*) shows the minimum point to which the mandrel has to be pushed. Rolling according to this invention is started by pushing the mandrel at a speed greater than the pass-bottom peripheral speed of the first roll set and smaller than that of the last roll set. The mandrel is pushed forward at least until the front end of the workpiece has passed the roll center line of the first half of the whole roll sets. To be more precise, the thrust block 15 continues to push the mandrel 11 until the front end Q of the workpiece P has passed the roll center line 4' of the fourth roll set. Until the point of FIG. 3 (*a*) is reached, the thrust block speed $V_t(=V_m)$ is held within the following range:

When Q is between the axes 1' and 2', $$V_1<V_t<V_{8\ tm} \quad (1)$$

When Q is between the axes 2' and 3'

$$C_2(V_1+V_2)/2<V_t<V_8 \quad (2)$$

When Q is between the axes 3' and 4', $$C_3(V_1+V_2+V_3)/3<V_t<V_8 \quad (3)$$

When Q has passed the axis 4', $$C_4(V_1+V_2+V_3+V_4)/4<V_t<V_8 \quad (4)$$

$C_2$ through $C_4$ are correcting coefficients used for equation simplification, falling between 0.7 and 1.1 in numerical value. Experimentally, the lower limit for equations (2) through (4) is determined as the mandrel speed with the full-floating mill. The most favorable upper limit is $V_3$, as discussed later. The speed relationship between the two adjacent roll sets is expressed by the following two equations:

$$V_1 < V_i < V_{i+1} \leqq V_8 \qquad (i = 2 \ldots\ldots 7) \quad (5)$$
$$A_1V_1 \leqq A_iV_i \leqq A_oV_1 \qquad (i = 2 \ldots\ldots 8) \quad (6)$$

$A_o$ and $A_i$ indicate the cross-sectional area of the workpiece at the entry end and on the delivery side of the i-th roll set, respectively.

$A_o$ is predetermined, and expressed by the following equation if the outside diameter and wall thickness of the workpiece at the entry end are $D_o$ and $t_o$:

$$A_o=\pi t_o(D_o-t_o) \quad (7)$$

$A_i$ can be determined empirically from the pass size and mandrel diameter, using the following equation:

$$A_i = \pi\left(\frac{t_{i-1}+t_i}{2}\right)\left(\frac{D_{i-1}+D_i}{2}-\frac{t_{i-1}+t_i}{2}\right) \quad (8)$$
$$(i = 1 \ldots\ldots 8)$$

Here, $t_i$ is the wall thickness of the workpiece at the pass bottom in the i-th roll set, which is expressed as follows if the shorter axis of the pass is $H_i$ and the mandrel diameter is M:

$$t_i = (H_i - M)/2 \qquad (i = 1 \ldots\ldots 8) \quad (9)$$

Equations (1) through (9) will be explained in the following paragraphs. Equation (1) shows that the speed of the thrust block is between the pass-bottom peripheral speeds of the first and last roll sets. The lower limit of equations (2), (3) and (4) shows the condition under which the thrust block continues to exert pushing force on the mandrel even after the workpiece front end Q has been bitten by the second, third and fourth roll sets, respectively. Their upper limit shows the same fact as equation (1). Equation (5) shows an increase in the peripheral speed of the rolls toward the exit end. Equation (6) shows that material flow change is permissible within the limit that the neutral point does not deviate from the pass bottom of the first roll set. Equations (7), (8) and (9) were already explained.

The following objects are achieved by pushing forward the mandrel at least until the front end of the workpiece has passed the roll center lines of the first half of the whole roll sets under the afore-mentioned conditions, which constitutes the first feature of this invention:

(1) Improvement of product dimensional accuracy.
(2) Reduction of roll torque on biting the workpiece.
(3) Prevention of miss-biting.
(4) Reduction of crack development on the mandrel surface and prevention of mandrel fracture.

Effect (1) is the result of bringing the mandrel speed variation during rolling much below one with the full-floating process, and closer to one on the semi-floating mill. Effects (2) and (3) are obtained by pushing forward the mandrel while the front end of the workpiece is passing through the roll center line of the first half roll sets giving larger reduction. Effect (4) results from the pushing of the mandrel that reduces the tensile stress working thereon between the adjacent roll sets. At the same time, it increases and makes uniform (or decreases variations in) the mandrel speed, moderating heat concentration per unit length of the mandrel.

FIG. 3 (*b*) shows the latest point to which the mandrel is pushed. That is, the pushing of the mandrel is stopped between the two points shown in FIGS. 3 (*a*) and (*b*). This lowers the cost of the mandrel thrust block, shortens its withdrawal time, and increases rolling efficiency.

FIG. 3 (*d*) shows the mandrel disengaged from the thrust block. Namely, the mandrel 11 must be released from the thrust block 15 by the time the tail end R of the workpiece has reached the last, or the eight, roll set 8, at latest. Intermediate between the conditions of FIGS. 3 (*b*) and (*d*), as shown in FIG. 3 (*c*) for example, the mandrel continues to advance, but it is no longer pushed forward, either released from the thrust block or kept at the desired speed thereby.

A second feature of this invention relates to the timing of releasing the mandrel from the thrust block. The most favorable releasing timing for the eight-stand mill is at the third roll set from the entry end. Generally, the best timing is after the tail end of the workpiece has cleared a roll set whose serial number can be expressed as $(n/2-1)$, n being the number of the whole roll sets in the mill, and before the tail end of the workpiece has been rolled by the last roll set. The best result is obtained when the mandrel is released from the thrust block between the points shown in FIGS. 3 (*c*) and (*d*). Between the points in FIGS. 3 (*b*) and (*d*), the mandrel kept under this condition pulls the thrust block as it advances. Therefore, tensile stress acts on the mandrel. This tensile stress is smaller, and lasts for a shorter time, than on the conventional semifloating mill. Besides, the mandrel moves at a greater speed, too. Therefore, effect (4) mentioned before is not impaired. Because of this second feature, the process according to this invention assures as high a rolling efficinecy as that of the conventional full-floating process, and as high a product dimensional accuracy as that of the conventional semi-floating process.

The mandrel speed during rolling should preferably be kept not higher than the pass-bottom peripheral speed at the third roll set from the entry end. Otherwise, the mandrel length must be made greater than conventional, which is not only uneconomical, but also make its removal difficult, offsetting the advantages of this invention.

On completion of rolling according to this process, a considerable length of the pipe P has already left the mandrel 11 behind, thus making its subsequent removal easier. While passing through the half of the whole roll sets, the mandrel 11 is pushed forward in the workpiece P to insure good biting. The mandrel is kept at the desired speed until the deformation of the workpiece has been substantially completed. All this results in well-sized and well-shaped pipes. If the thrust block continues to hold the mandrel until the workpiece has left the last roll set, the pipe speed sharply drops to the mandrel speed on completion of rolling, failing to agree with the delivery speed of the exit-end rollers. This will cause roller scratch marks on the pipe surface, and lengthen the run-out time of the mandrel and, therefore, the operation cycle time. Therefore, the mandrel 11 must be released not later than the time indicated in FIG. 4 (*d*).

Premature releasing of the mandrel 11, on the other hand, impairs dimensional accuracy, though it increases rolling efficiency. FIG. 3 (*c*) shows the earliest point for mandrel releasing. As seen, the mandrel 11 should not be released until the tail end R of the workpiece has passed the roll set 3, or one whose serial number is expressed as $(n/2-1)$ as mentioned before. The premature releasing shortens the mandrel length and the thrust block retraction distance. But the mandrel speed cannot be maintained at the desired level a long enough distance, offsetting the dimensional accuracy improving effect on the pipe tail end.

To maintain good dimensional accuracy on the pipe tail end when the mandrel is released at the point shown in FIG. 3 (*a*), more than 75 percent of total wall thickness reduction must preferably be performed on the three roll sets 1, 2 and 3. When the mill consists of three sets of rolls (though which is a rare case), the most desirable last timing for mandrel releasing lies where the tail end Q of the workpiece stays between the first and last roll sets.

As discussed above, the timing for releasing the mandrel 11 is limited within a certain period of time. In selecting the releasing timing, not only the thrust speed of the mandrel but also the distribution of draft among the individual roll sets must be taken into account.

To push the mandrel through the workpiece being rolled, the pushing force applied on the mandrel must be greater than the peripheral speed at the pass bottom in the first roll set. On contacting the roll pass, the front end of the workpiece is pushed forward by the mandrel, whereupon a frictional thrust force develops between the internal surface of the workpiece and the mandrel, which assists in sending the workpiece into the bite of the roll set. The roll torque required here is much lower than on the conventional full-floating or semi-floating mill. It may be made negative, too. The same bite-facilitating effect can be achieved at the second roll set, if the mandrel is pushed forward at a speed greater than the pass-bottom peripheral speed thereof. Otherwise, the biting roll torque reducing effect is offset. As the peripheral speed at the pass bottom increases toward the exit end, the same effect is obtained as the front end of the workpiece proceeds from one pass to another. The mandrel need not be pushed forward faster than the pass-bottom peripheral speed of the last roll set. This is because the last roll set gives only slight deformation, free from ill-biting and, therefore, the need of roll torque reduction.

When the mill consists of eight roll sets, it is most desirable to push forward the mandrel at a speed lower than the pass-bottom peripheral speed of the third roll set from the entry end (or, generally, a roll set positioned at n/2−1 as mentioned previously). This prevents the increase of mandrel length and facilitates mandrel removal from the rolled pipe.

The following three mandrel speed patterns are suited for the eight-stand rolling mill;

(1) To fix at a constant speed not lower than the pass-bottom peripheral speed of the first stand and not higher than that of the third stand from the entry end. This pattern calls for costly provision of a rigid mandrel holder and a mandrel pusher with large enough capacity to control disturbance. But the previously described effects of this invention are achieved most pronouncedly.

(2) To increase the speed progressively as the workpiece advances, within the limits not lower than the pass-bottom peripheral speed of the first stand and not higher than that of the third stand from the entry end. This pattern permits reducing the mandrel pusher capacity considerably, scarcely damaging the effects of this invention. Unlike the case (1), the rolled pipe may exhibit more moderate dimensional variation throughout its length. But no such great localized variation as on the conventional pipe occurs.

(3) To start with a speed not lower than the pass-bottom peripheral speed of the first stand, holding its increase to a small extent until the tail end of the workpiece has passed the third stand from the entry end. The maximum mandrel speed within this range should not exceed the pass-bottom peripheral speed of the third stand. This pattern can be achieved with the simplest, cheapest mandrel pusher.

Figure 7:
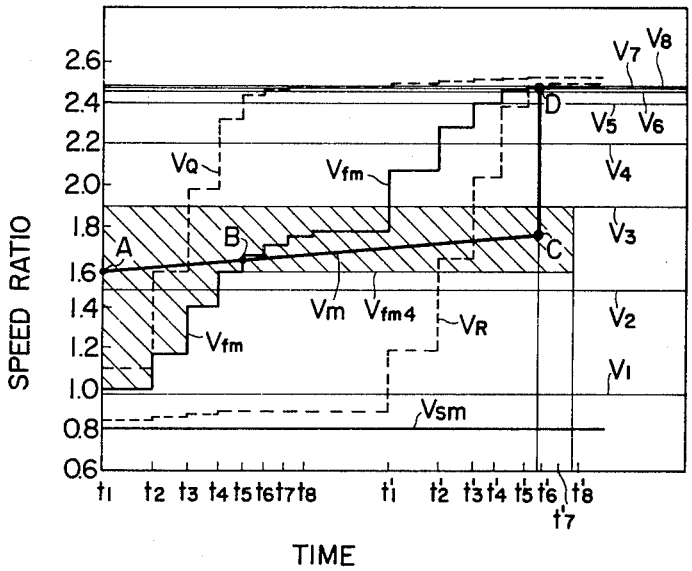
FIG. 7 compares the mandrel speeds in the process of this invention and the conventional one.

FIG. 7 compares the mandrel speeds on the eight-stand mills according to this invention and the conventional process. Passage of time is plotted as abscissa, with $t_1$, $t_2$ . . . $t_8$ indicating the time at which the first, second . . . and eight roll sets bite the front end of the workpiece, and $t_1'$, $t_2'$ . . . $t_8'$ the time at which the tail end of the workpiece clears the first, second . . . and eighth roll sets. Speed ratio based on the mandrel speed with rolling on the first roll stand alone is plotted as ordinate. $V_Q$ and $V_R$ are the speeds of the front and tail ends of the workpiece. $V_{sm}$ is the mandrel speed with the semi-floating process, having a constant value smaller than $V_R$ between $t_1$ and $t_2$. $V_{fm}$ is the mandrel speed with the full-floating process, sharply increasing, in a step-like pattern, every time the front and tail ends of the workpiece pass the roll sets. The hatched area shows the speed range allowable for the mandrel held by the thrust block according to this invention. $V_m$ shows an example of the mandrel speed according to this invention. The mandrel pattern shown is for the type (2) described before. The mandrel between the thrust block and the first roll set receives compressive stress on the left of $V_{fm}$ and tensile stress on the right thereof. According to this invention, intersection point B appears after $t_4$. The mandrel is released at point C that exists between $t_3'$ and $t_8'$. On being released at point C, the mandrel is continuously held under the rolling action, with its speed $V_m$ increasing sharply to agree with the mandrel speed $V_{fm}$ with the full-floating process. The mandrel speed according to this invention is not lower than $V_{fm}$ up to $t_4$, and, beyond $t_4$, not lower than the mandrel speed ($V_{fm4}$) on the full-floating mill with the front end of the workpiece between the fourth and fifth roll sets. The mandrel speed according to this invention preferably should not be higher than the pass-bottom peripheral speed of the third roll set before being released.

The following paragraphs describe the distribution of wall thickness reduction ratio on the rolling mill.

Distribution of wall thickness reduction according to this invention resembles that of the full-floating process. The first half roll stands perform 80 percent or more of the total wall thickness reduction scheduled for the entire mill. On a common mandrel mill comprising eight sets of rolls, the first four roll passes provide 80 percent or greater wall thickness, reduction at their bottom. More preferably 75 percent or more of the total wall thickness reduction should be given by the first three passes. The ratio of wall thickness reduction for each stand to the entire reduction is determined by the following equation:

$$R_k = \frac{t_o - t_k}{t_o - t_n}$$

where $R_k$=ratio of wall thickness reduction up to the k-th stand to that on all stands (n in number)

$t_o$=wall thickness of tubular blank before rolling $t_k$=wall thickness leaving the pass bottom of the k-th stand $t_n$=wall thickness leaving the pass bottom of the last stand When the wall thickness reduction ratio is distributed as described above and the mandrel is released at a point not earlier than that shown in FIG. 3 (*c*), the rolled pipe is finished to a high accuracy comparable to one resulting from the semi-floating process, except the tail end thereof that remains within the rolling mill when the mandrel is released from the thrust block. Even the tail end, which has been given 75 percent or more of the total scheduled reduction, is finished to a higher dimensional accuracy than on the conventional mandrel mill. The dimensional accuracy of the tail end can be improved by reducing the diameter difference (clearance) between the mandrel and inside wall of the rolled pipe, as compared with the conventional full-floating mill. This clearance reduction decreases the formation of ridges on the internal surface of the mandrel mill products, thereby improving their dimensional accuracy. With the conventional full-floating process, a considerable portion of the mandrel still remains inside the workpiece on completion of rolling. This necessitates a large clearance to permit the subsequent removal of the mandrel. According to the process of this invention, by contrast, a considerable portion of te mandrel leaves the workpiece during rolling, with the mandrel speed held below the pass-bottom peripheral speed at the far-side roll stand. Therefore, the subsequent mandrel removal can be accomplished easily, permitting the above-described clearance reduction.

Figure 4:
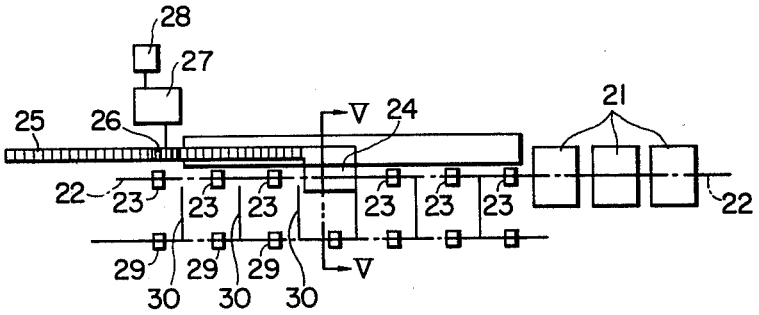
FIG. 4 is a schematic plan view exemplifying a rolling mill and its entry-side equipment, including a thrust block, on which the process of this invention is implemented.
Figure 5:
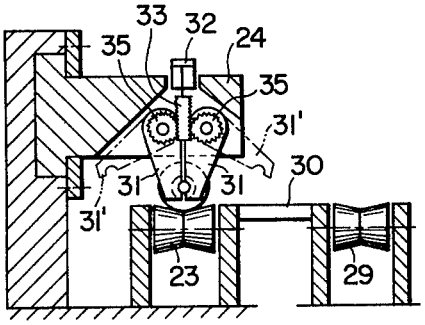
FIG. 5 is a cross-sectional view taken along the line V—V of FIG. 4.

The following describes equipment on the entry side of the rolling mill. FIG. 4 shows an arrangement of rolling mill and a thrust block according to this invention. As shown, roller tables 23 are provided in a straight line on the entry side of a rolling mill 21, on the extension of the pass line 22 thereof, to deliver a tubular blank and a mandrel to the rolling mill 21. A thrust block 24 is provided on the roller tables 23 so as to be moved back and forth in the rolling direction by a pinion 26 meshed with a rack 25. Reference numeral 27 denotes a reduction gear for the pinion, and 28 a motor. The mandrel is inserted in the workpiece on roller tables 29 disposed parallel to the roller tables 23. The workpiece, with the mandrel inserted therein, is passed over skids 30 onto the roller tables 23. FIG. 5 is a cross-sectional view taken along the line V—V of FIG. 4. Before the front end of the workpiece starts to be rolled, a cramping lever 31 of the thrust block catches the tail end of the mandrel. The mandrel is sent into the rolling mill at the desired, controlled speed. The thrust block cramping lever can be opened and closed by rotating a pinion 35 through the movement of a rack 33 by a cylinder 32. When the tail end of the workpiece has passed the third roll set from the entry end, the cylinder 32 operates to open the cramping lever to position 31', whereupon the mandrel is released and the thrust block withdrawn. The opening of the cramping lever is large enough to avoid interference with the next workpiece proceeding into position.

As will be understood from the above description, this equipment assures as good rolling efficiency as the full-floating mill, without the necessity for retracting the mandrel as on the semi-floating mill. Withdrawal of the thrust block can be accomplished while the tail end of the workpiece is being rolled in the far-side roll sets or the next tubular blank is approaching the rolling mill, without increasing the rolling cycle time. By providing separate pass lines to the tubular blank and thrust block and opening the mandrel tail catching device, forward movement of the tubular blank can be interlocked with backward movement of the thrust block.

Figure 6:
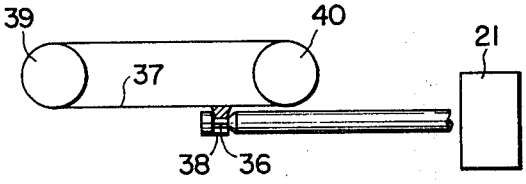
FIG. 6 schematically shows an embodiment of a mandrel transfer device.

FIG. 6 shows another embodiment of mandrel carriage. With a small-diameter portion 36 near the mandrel tail engaged with a recess in a cramping part 38 projecting over a chain 37, rotation of a sprocket 39 is restrained by means of a motor etc. On reaching, with the mandrel, a sprocket 40 near the rolling mill 21, the cramping part 38 runs along the periphery of the sprocket 40, leaving the straight pass line, to release the mandrel. This release must be effected when the tail end of the workpiece has passed predetermined roll set. To insure this timing, positional relationship between the workpiece and mandrel should be established within a given range before starting rolling.

Now two examples are given to compare the continuous pipe rolling process of this invention with the conventional one.

EXAMPLE I

Table 1 compares the rolling results obtained from the push-mandrel rolling according to this invention and the conventional full-floating rolling.

TABLE 1

| Description | Conventional | Present Invention |
|---|---|---|
| Tubular blank size (mm) | 81 dia. × 8.0 thick | Same as left |
| Rolled pipe size (mm) | 69 dia × 4.0 thick | " |
| Steel type | Low-carbon steel | " |
| Peripheral speed at pass bottom (mm/sec.) | | |
| No. 1 roll stand | 200 | " |
| No. 2 roll stand | 280 | " |
| No. 3 roll stand | 360 | " |
| Accumulated elongation ratio (times) | | |
| No. 1 roll stand | 1.45 | " |
| No. 2 roll stand | 1.98 | " |
| No. 3 roll stand | 2.25 | " |
| Mandrel pushing speed (mm/sec.) | — | 320 |
| Maximum biting torque ratio | | |
| No. 1 roll stand | 1.0 | 0.3 |

TABLE 1-continued

| Description | Conventional | Present Invention |
|---|---|---|
| No. 2 roll stand | 1.0 | 0.3 |
| No. 3 roll stand | 1.0 | 1.0 |
| Incidence of miss-biting (%) | 12 | 0 |
| Mandrel speed change ratio | 1.8 | 1.2 |

This data is based on a test rolling mill, scaled to ½ of a full-size commercial mill, both exhibiting the same tendency. The same rolling conditions were employed, except mandrel operation. With the conventional process, no other external forces worked on the mandrel than that exerted by the rolls. The mandrel according to this invention was pushed forward at a speed higher than that of the first and second roll sets and lower than that of the third roll set. This permitted reducing the maximum biting torque ratio to 0.3 at the first roll set and 0.4 at the second, as compared with 1.0 for both sets on the conventional mill. This means that the power of the roll driving motors can be reduced accordingly. The incidence of miss-biting was as high as 12% for the conventional process. Due to the pushing of the mandrel, the process of this invention suffered none. The mandrel speed on the conventional mill increased stepwise every time the workpiece end passed a roll set, marking a speed change ratio of 1.8 times. With the mandrel pushed forward at high speed, the change ratio for the process of this invention was only 1.2 times. This has a relation to the variation of pipe deformation inside the roll pass. The process of this invention, operated with a lower mandrel speed change ratio, permits the workpiece to deform at a constant rate. This permits employing roll passes closer to true circle, with little allowance for overfill, which, in turn, contributes to finishing pipes to higher dimensional accuracy.

EXAMPLE II

Table 2 compares the results obtained from the process of this invention and the conventional full-floating process operated on a ½ scale mode mill.

TABLE 2

| Description | Conventional | Present Invention |
|---|---|---|
| No. of roll stand | 6 | 6 |
| Tubular blank size (mm) | 89 o.d. × 12.0 thick | Same as left |
| Rolled pipe size (mm) | 73 o.d. × 4.0 thick | 69 o.d. × 4.0 thick |
| Wall thickness leaving No. 3 stand pass bottom (mm) | 4.6 | Same as left |
| Wall thickness reduction ratio up to No. 3 stand | 0.925 | Same as left |
| Clearance between rolled pipe inside dia. and mandrel (mm) | 5.0 | Same as left |
| Mandrel diameter (mm) | 60.0 | Same as left |
| Outside diameter accuracy of rolled pipe | | |
| $D_{max} - D_{min}$ (mm) | 4.63 | 2.89 |
| $Di_{max} - Di_{min}$ (mm) | 3.05 | 2.55 |
| Mean ellipticity (mm) | 2.97 | 1.10 |
| Wall thickness accuracy of rolled pipe | | |
| $t_{max} - t_{min}$ (mm) | 1.36 | 0.82 |
| $ti_{max} - ti_{min}$ (mm) | 0.88 | 0.61 |

TABLE 2-continued

| Description | Conventional | Present Invention |
|---|---|---|
| Mean thickness variation (%) | 9.6 | 5.4 |

Six roll stands were used. Peripheral speeds at the pass bottom were as follows: $V_1=200$, $V_2=305$, $V_3=420$, $V_4=450$, $V_5=480$ and $V_6=490$mm/sec. In the process of this invention, the mandrel was pushed forward until the front end of the workpiece has passed the third roll stand. The thrust block kept the mandrel speed at 300 mm/sec. until the tail end of the workpiece has been rolled on the third roll stand from the entry end. Then the mandrel was released from the thrust block. As much as 92.5 percent of the total scheduled wall thickness reduction was completed on and before the third roll stand. All indices evidence that the process of this invention finished the outside diameter to higher accuracy than the conventional process. $D_{max}-D_{min}$ indicates a difference between the maximum and minimum outside diameters of a pipe. $Di_{max}-Di_{min}$ indicates a diameter difference in a cross-sectional plane of a pipe. Mean ellipticity indicates the average of $Di_{max}-Di_{min}$ throughout the entire length of a pipe. The same is true of wall thickness accuracy, with the process of this invention indicating better indices. $t_{max}-t_{min}$ indicates a difference between the maximum and minimum wall thicknesses of a pipe. $ti_{max}-ti_{min}$ indicates a wall thickness difference in a cross-sectional plane of a pipe. Mean thickness variation indicates the average of wall thickness variations throughout the entire length of a pipe, which is expressed in terms of percentage derived by dividing $ti_{max}-ti_{min}$ by the mean wall thickness of the cross-sectional plane.

The examples shown in Table 2 are typical of the two rolling processes. The above-described effects of this invention are not offset by the increase of roll stands.

As evident from the above description, this invention provides an excellent continuous pipe rolling process, combining the advantages of the conventional full-floating and semi-floating processes and eliminating their defects.

In addition to the above-described embodiments and effects, this invention can evidently achieve the following secondary effects. Freedom from miss-biting permits reducing the roll diameters, which in turn, shortens the arc of contact on the rolls, increases the mandrel life, and lowers the rolling load. Reduction of the moment of inertia of the driving motors, reduction gears and rolls improves the speed control response. The rolling mill size can be reduced, too. With the existing rolling mill, the first half roll sets can give greater reduction than conventional.

The mandrel pusher of this invention may be a hydraulic cylinder, pinion-rack combination, chain, or other suitable known device. Preferably, the mandrel support comprises rollers that hold the mandrel at one time, and a tubular blank, inserted with the mandrel, at another. Also preferably, the rollers are capable of opening and closing between the mandrel support position and the tubular blank support position, detecting the passage of the workpiece end.

What is claimed is:

1. A process of rolling a tubular blank into a pipe by elongation, diameter and wall thickness reduction which comprises passing the blank continuously through a mill having a plurality of roll sets each comprising grooved driven rolls providing substantially circular passes of progressively reduced diameters, and supporting the interior of the tubular blank with a mandrel during its passage through said roll sets, the improved process comprising holding the tail end of the mandrel with pushing means, starting rolling by pushing the mandrel into the tubular blank, stopping the pushing of the mandrel between the time when the front end of the workpiece has passed the last roll center line in the first half roll set group and the time when the front end of the workpiece has reached before the roll center line of the last roll set and continuing the rolling of the workpiece holding the tail end of the mandrel.

2. A continuous pipe rolling process according to claim 1, wherein the mandrel is released from the pushing means between the time when the tail end of the workpiece has passed the roll center line of the second last roll set in the first bisected roll set group and the time when the tail end of the workpiece has passed the roll center line of the last roll set, and the workpiece is continuously rolled through one or more roll sets with the released mandrel.

3. A continuous pipe rolling process according to claim 1, wherein the mandrel is pushed forward at a speed greater than the peripheral speed of roll at the pass bottom of the first roll set and smaller than that of the second last roll set in the first bisected roll set group.

4. A continuous pipe rolling process according to claim 1, wherein the mandrel is pushed forward at a constant speed.

5. A continuous pipe rolling process according to claim 1, wherein the mandrel is pushed forward at a speed increasing with the advance of the workpiece.

6. A continuous pipe rolling process according to claim 1, wherein an increase in the mandrel push speed is controlled.

7. A continuous pipe rolling process according to claim 1, wherein no less than 75 percent of the total wall thickness reduction is performed on and before the second last roll set in the first bisected roll set group.

* * * * *